US007511694B2

(12) United States Patent
Kim et al.

(10) Patent No.: US 7,511,694 B2
(45) Date of Patent: Mar. 31, 2009

(54) SOURCE DRIVER THAT GENERATES FROM IMAGE DATA AN INTERPOLATED OUTPUT SIGNAL FOR USE BY A FLAT PANEL DISPLAY AND METHODS THEREOF

(75) Inventors: Hyung-tae Kim, Gyeonggi-do (KR); Woo-nyoung Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 694 days.

(21) Appl. No.: 11/258,471

(22) Filed: Oct. 25, 2005

(65) Prior Publication Data

US 2006/0092119 A1 May 4, 2006

(30) Foreign Application Priority Data

Oct. 28, 2004 (KR) ..... 10-2004-0086560

(51) Int. Cl.
*G09G 3/36* (2006.01)

(52) U.S. Cl. ..... 345/98; 345/99; 345/100; 345/204; 345/690

(58) Field of Classification Search ..... 345/98–100, 345/204, 690

See application file for complete search history.

(56) References Cited

U.S. PATENT DOCUMENTS 5,773,873 A 6/1998 Kuriyama ..... 257/563
6,469,647 B1 * 10/2002 Kinugasa et al. ..... 341/145
2005/0088329 A1 * 4/2005 Tsuchi ..... 341/144

FOREIGN PATENT DOCUMENTS

JP 07-283666 10/1995
JP 08-102628 4/1996
JP 08-250940 9/1996

* cited by examiner

*Primary Examiner*—Richard Hjerpe
*Assistant Examiner*—Leonid Shapiro
(74) *Attorney, Agent, or Firm*—Myers Bigel Sibley & Sajovec, P.A.

(57) ABSTRACT

A source driver that responds to image data by generating an output signal which can be used to drive a flat panel display. The source driver includes a gamma decoder and an amplifier. The gamma decoder selects a first voltage among first analog gray voltages based on some upper bits of the image data, selects a second voltage among second analog gray voltages based on other upper bits of the image data, and selectively outputs at least one of the first and second voltages as a plurality of distributed analog signals in response to lower bits of the image data. The amplifier interpolates between the distributed analog signals from the gamma decoder to generate the output signal of the source driver. The amplifier includes bias circuits that are each configured to generate a bias current, and a plurality of MOSFETs. Each of the MOSFETs includes a source, a drain, and a gate terminal. The gate terminal of each of the MOSFETS is separately connected to receive a different one of the distributed analog signals from the gamma decoder. One of the source/drain terminals of each of the MOSFETS is separately connected to a different one of the bias circuits to receive the bias current, and the other one of the source/drain terminals of each of the MOSFETS is connected together at an output node to generate an interpolated signal. The output signal is based on the interpolated signal.

17 Claims, 6 Drawing Sheets

| D[9]~D[3] | D[2] | D[1] | D[0] | DECODER OUTPUT | A, B, C, D | OUT |
|---|---|---|---|---|---|---|
| XXXXXXX | 0 | 0 | 0 | V1, V2 | V1, V1 ,V1, V1 | V1 |
| XXXXXXX | 0 | 0 | 1 | | V1, V1, V1, V2 | (3V1+V2)/4 |
| XXXXXXX | 0 | 1 | 0 | | V1, V1, V2, V2 | (2V1+2V2)/4 |
| XXXXXXX | 0 | 1 | 1 | | V1, V2, V2, V2 | (V1+3V2)/4 |
| XXXXXXX | 1 | 0 | 0 | | V2, V2, V2, V2 | V2 |

| D[9]~D[2] | D[1] | D[0] | DECODER OUTPUT | A, B | OUT |
|---|---|---|---|---|---|
| XXXXXXXX | 0 | 0 | V1, V2 | V1, V1 | V1 |
| XXXXXXXX | 0 | 1 | | V1, V2 | (V1+V2)/2 |
| XXXXXXXX | 1 | 0 | | V2, V2 | V2 |

SOURCE DRIVER THAT GENERATES FROM IMAGE DATA AN INTERPOLATED OUTPUT SIGNAL FOR USE BY A FLAT PANEL DISPLAY AND METHODS THEREOF

PRIORITY STATEMENT

This U.S. non-provisional patent application claims priority under 35 U.S.C. § 119 to Korean Patent Application No. 10-2004-0086560, filed on Oct. 28, 2004 in the Korean Intellectual Property Office, the disclosure of which is incorporated herein in its entirety by reference.

FIELD OF THE INVENTION

The present invention relates to flat panel display devices and, more particularly, to source drivers for driving source lines of flat panel display devices.

BACKGROUND OF THE INVENTION

Some types of flat panel display devices are TFT-LCDs (Thin Film Transistor-Liquid Crystal Displays), EL (Electro Luminance) displays, STN (Super Twisted Nematic)-LCDs, and PDPs (Plasma Display Panels).

FIG. 1 is a block diagram of a conventional TFT-LCD 100 that includes a TFT-LCD panel 110 and peripheral circuits. The TFT-LCD panel 110 includes an upper plate and a lower plate, each including a plurality of electrodes for forming electric fields, a liquid crystal layer between the upper and lower plates, and polarization plates for polarizing light which are respectively attached to the upper and lower plates. The brightness of light that is transmitted through the TFT-LCD 100 is controlled by applying corresponding voltages (gray voltages) to pixel electrodes to re-arrange liquid crystal polymers in the liquid crystal layer and cause various gray levels. To apply the gray voltages to the pixel electrodes, a plurality of switching devices, such as TFTs, connected to the pixel electrodes are located on the lower plate of the TFT-LCD panel 110. The switching devices (e.g., TFTs) control the brightness (transmissivity) of light through a pixel area and, for color displays, three colors (e.g., R (Red), G (Green), and B (Blue)) can be formed through a pixel array with a color filter arrangement, such as that shown in FIG. 2.

The TFT-LCD 100 includes gate drivers 120 for driving a plurality of gate lines arranged horizontally and source drivers 130 for driving a plurality of source lines arranged vertically. The source and gate lines are arranged on the LCD panel 110. The gate and source drivers 120 and 130 are controlled by a controller (not shown). Generally, the controller is provided outside the LCD panel 110. The gate and source drivers 120 and 130 are generally located outside the LCD panel 110, however, they can be located on the LCD panel 110 in a COG (Chip On Glass) display.

FIG. 3 is a block diagram of a conventional source driver 130. Referring to FIG. 3, the conventional source driver 130 includes a plurality of gamma decoders 131 and buffers 132. Each gamma decoder 131 receives n bits of image data (n=6, 8, 10, . . . ), and selects and outputs an analog voltage corresponding to a digital value of the image data among 2*n* analog gray voltages. The image data is digital data obtained by processing a three-color signal (e.g., RGB digital data) transmitted from an external source such as a graphics card in the controller according to a resolution of the LCD panel 110. Analog image signals output from the gamma decoders 131 are buffered by the corresponding buffers 132 and respectively output to source lines S1, S2, S3, S4, etc. The analog image signals output from the buffers 132 quickly charge the source lines S1, S2, S3, S4, etc. and corresponding pixels on the LCD panel 110. Liquid crystal molecules of the pixels receiving the image signals are re-arranged in proportion to applied gray voltages, and thereby control the brightness of light transmitted therethrough.

To enhance color reproducibility by increasing the number of bits of R, G, and B image data, the area of a gamma decoder circuit used to decode the bits can increase in proportion to the increased number of bits. To avoid such increase in circuit complexity, an amplifier interpolation scheme has been developed. According to one such amplifier interpolation scheme, representative gray voltages are selected based on upper bits of digital image data and intermediate values are created from the selected representative gray voltages based on the remaining lower bits. The amplifier interpolation scheme can use a half method capable of reducing the gamma decoder circuit area by ½ or a quarter method capable of reducing the area by ¾. In the half method, intermediate interpolated voltages are created from representative gray voltages selected based on the upper bits of input image data. In the quarter method, interpolated voltages with ¼ the interval of representative gray voltages selected based on the upper bits of input image data are created.

This conventional amplifier interpolation scheme depends on input voltages of an amplifier used for interpolation. Interpolation of the voltages can become skewed if differences between input voltages of the amplifier are not small or if the differences are not equal for all gray levels. Accordingly, a source driver that uses the conventional interpolation scheme may not create interpolated voltages that enable generation of stable and uniformly distributed gray level differences.

SUMMARY OF THE INVENTION

Some embodiments of the present invention provide a source driver that responds to image data by generating an output signal which can be used to drive a flat panel display. The source driver includes a gamma decoder and an amplifier. The gamma decoder is configured to select one of a plurality of first analog gray voltages as a first voltage based on some upper bits of the image data, to select one of a plurality of second analog gray voltages as a second voltage based on other upper bits of the image data, and to selectively output at least one of the first voltage and the second voltage as a plurality of distributed analog signals in response to lower bits of the image data. The amplifier is configured to interpolate between the distributed analog signals from the gamma decoder to generate the output signal of the source driver. The amplifier includes a plurality of bias circuits and a plurality of MOSFETs. The bias circuits are each configured to generate a bias current. Each of the MOSFETs includes a source, a drain, and a gate terminal. The gate terminal of each of the MOSFETS is separately connected to receive a different one of the distributed analog signals from the gamma decoder. One of the source and drain terminals of each of the MOSFETS is separately connected to a different one of the bias circuits to receive the bias current, and the other one of the source and drain terminals of each of the MOSFETS is connected together at an output node to generate an interpolated signal. The output signal is based on the interpolated signal.

In some further embodiments, the gamma decoder includes a gamma voltage generator and an amplifier input voltage selector. The gamma voltage generator is configured to generate the plurality of first analog gray voltages and the plurality of second analog gray voltages based on a number of different logic combinations of the upper bits of the image data. The amplifier input voltage selector is configured to select one of the plurality of first analog gray voltages as the first voltage in response to some upper bits of the image data, and to select one of the plurality of second analog gray voltages as the second voltage in response to other upper bits of the image data, and selectively outputs at least one of the first voltage and the second voltage as the plurality of distributed analog signals in response to the lower bits of the image data.

In some further embodiments, the amplifier input voltage selector includes a first level selector that is configured to select one of the plurality of first analog gray voltages as the first voltage in response to some of the upper bits of the image data. A second level selector is configured to select one of the plurality of second analog gray voltages as the second voltage in response to other of the upper bits of the image data. An output selector is configured to selectively output at least one of the first voltage and the second voltage as the plurality of distributed analog signals in response to the lower bits of the image data. The output selector can selectively output different combinations of the first and second voltages across the plurality of distributed analog signals in response to the lower bits of the image data.

In some further embodiments, the plurality of distributed analog signals can include first and second analog signals. The output selector can output the first voltage as both of the first and second analog signals in response to a first logical value of the lower two bits of the image data, output the first voltage as the first analog signal and output the second voltage as the second analog signal in response to a second logical value of the lower two bits of the image data, and output the second voltage as both of the first and second analog signals in response to a third logical value of the lower two bits of the image data.

In some further embodiments, the plurality of distributed analog signals can include first, second, third, and fourth analog signals. The output selector can output the first voltage as each of the first, second, third, and fourth analog signals in response to a first logical value of the lower three bits of the image data, output the first voltage as the first, second, and third analog signals and output the second voltage as the fourth analog signal in response to a second logical value of the lower three bits of the image data, output the first voltage as the first and second analog signals and output the second voltage as the third and fourth analog signals in response to a third logical value of the lower three bits of the image data, output the first voltage as the first analog signal and output the second voltage as the second, third and fourth analog signals in response to a fourth logical value of the lower three bits of the image data, and output the second voltage as each of the first, second, third and fourth analog signals in response to a fifth logical value of the lower three bits of the image data.

In some further embodiments, magnitudes of numbered ones of the second analog gray voltages are between magnitudes of adjacent numbered ones of the first analog gray voltages.

In some further embodiments, the amplifier interpolates between the distributed analog signals from the gamma decoder to generate as the output signal a voltage with a level that corresponds to one of the first voltage, an average of the first and second voltage, and the second voltage. The amplifier may interpolate between the distributed analog signals from the gamma decoder to generate as the output signal a voltage with a level that corresponds to one of V1, (3V1+V2)/4, (V1+V2)/2, (V1+3V2)/4, and V2, where V1 is the first voltage and V2 is the second voltage.

Some other embodiments provide a method of driving a flat panel display device responsive to image data. First analog gray voltages are generated based on a number of different logic combinations of upper bits of the image data. Second analog gray voltages are generated based on the number of different logic combinations of the upper bits of the image data. One of the first analog gray voltages is selected as a first voltage based on some upper bits of the image data. One of the second analog gray voltages is selected as a second voltage based on other upper bits of the image data. At least one of the first voltage and the second voltage is selectively outputted as a plurality of distributed analog signals in response to lower bits of the image data. A plurality of separate bias currents are generated, and interpolation between the distributed analog signals is carried out using the separate bias currents to generate the output signal of the source driver.

DETAILED DESCRIPTION OF EMBODIMENTS OF THE INVENTION

Figure 1:
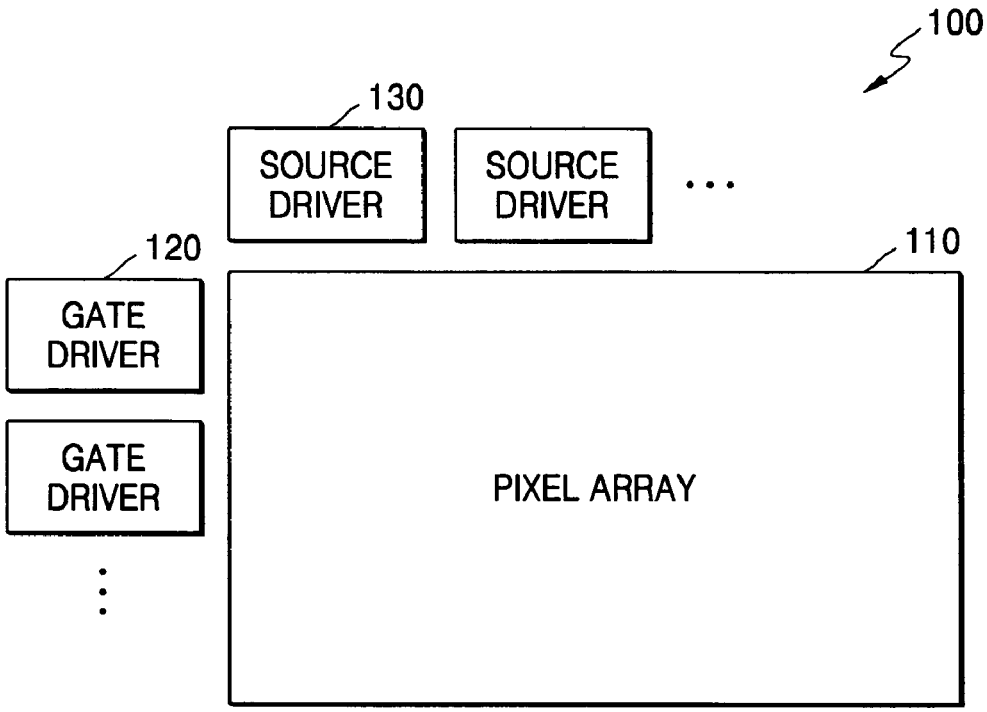
FIG. 1 (PRIOR ART)
FIG. 1 is a block diagram of a conventional TFT-LCD that includes a TFT-LCD panel and peripheral circuits.
Figure 2:
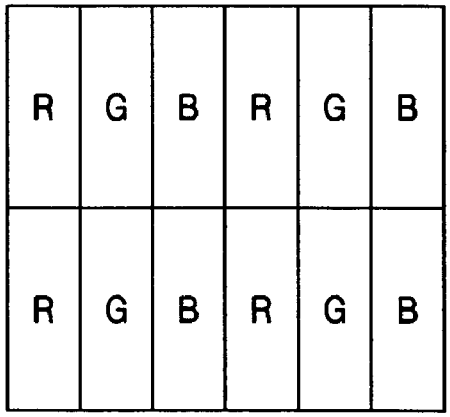
FIG. 2 (PRIOR ART)
FIG. 2 shows a conventional pixel structure.
Figure 3:
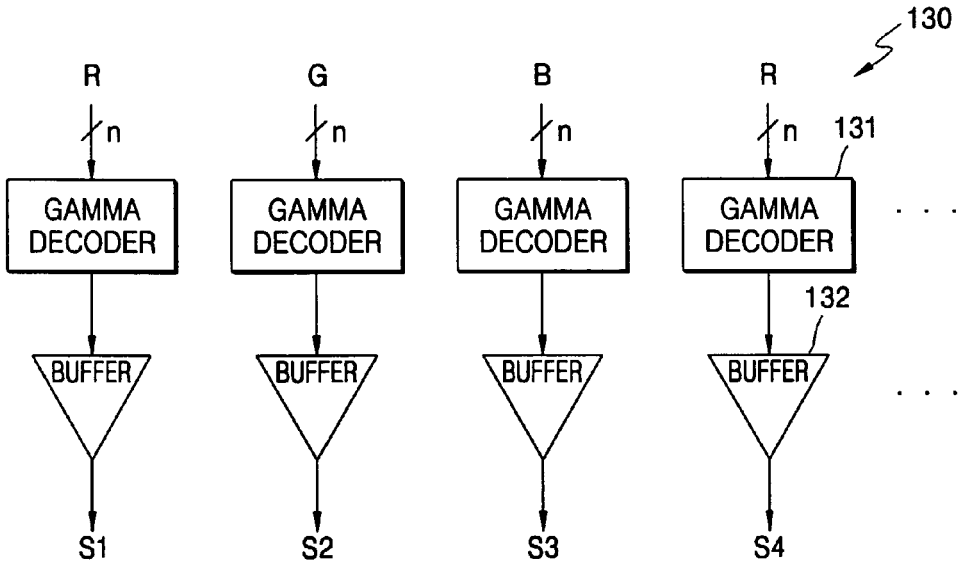
FIG. 3 (PRIOR ART)
FIG. 3 is a block diagram of a conventional source driver.

While the invention is susceptible to various modifications and alternative forms, specific embodiments thereof are shown by way of example in the drawings and will be described in detail herein. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the drawings.

It will be understood that when an element or layer is referred to as being "on," "connected to," or "coupled to" another element or layer, it can be directly on, connected, or coupled to the other element or layer or intervening elements or layers may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that although the terms first and second are used herein to describe various steps, operations, elements, and components, these steps, operations, elements, and components should not be limited by these terms. These terms are only used to distinguish one step, operation, element, or component from another step, operation, element, or component. Thus, a first step, operation, element, or component discussed below could be termed a second step, operation, element, or component, and similarly, a second step, operation, element, or component may be termed a first step, operation, element, or component without departing from the teachings of the present invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 4:
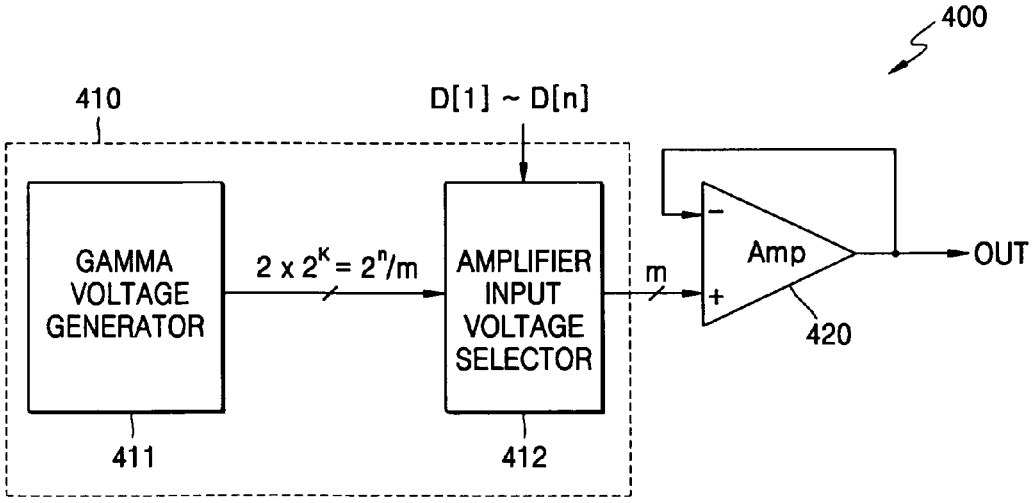
FIG. 4 is a block diagram of a source driver according to an embodiment of the present invention.

FIG. 4 is a block diagram of a source driver 400 according to embodiments of the present invention. Referring to FIG. 4, the source driver 400 includes a gamma decoder 410 and an amplifier 420. In FIG. 4, a single unit for driving a single source line is shown, however, it is also possible to configure a plurality of units corresponding to a plurality of source lines.

The gamma decoder 410 receives n bits of image data D[1] through D[n] (n=6, 8, 10, . . . ) and generates m distributed analog outputs. The image data D[1] through D[n] is digital data obtained by processing digital data of a three-color signal (that is, R (Red), G (Green), or B (Blue)) transmitted from an external source such as a graphic card in a controller (not shown) according to a resolution of a LCD panel. The amplifier 420 receives the m distributed analog outputs and generates corresponding analog interpolated voltages OUT. That is, if the gamma decoder 410 generates m different distributed outputs, the amplifier 420 generates interpolated voltages OUT corresponding to the m different distributed outputs. The interpolated voltages OUT output from the amplifier 420 drive source lines and liquid crystal polymers of pixels receiving the interpolated voltages OUT are re-arranged in proportion to corresponding gray voltages, thereby controlling the transmittance of light.

In FIG. 4, the gamma decoder 410 includes a gamma voltage generator 411 and an amplifier input voltage selector 412. The gamma voltage generator 411 generates first analog gray voltages and second analog gray voltages. The number of generated first analog gray voltages can be equal to the number (2k) of logic combinations capable of being created using the upper bits of the input image data D[1] through D[n]. The number of the second analog gray voltages can also be equal to the number (2k) of logic combinations of the upper bits.

The amplifier input voltage selector 412 selects a voltage corresponding to a digital value of the upper bits from the first analog gray voltages and a voltage corresponding to a digital value of the upper bits from the second analog gray voltages. The amplifier input voltage selector 412 selectively outputs at least one of the two selected voltages as the m distributed outputs according to the logic values represented by the remaining lower bits of the input image data D[1] through D[n]. The amplifier input voltage selector 412 will be described in more detail with reference to FIGS. 5 and 8.

In the source driver 400, which processes the image data D[1] through D[n], the gamma decoder 410 generates 2×2k analog gray voltages instead of 2n analog gray voltages, where k is the number of the predetermined upper bits of the image data D[1] through D[n] and 2×2k is less than 2n. When the amplifier input voltage selector 412 generates the m distributed outputs, the total number of the analog gray voltages generated by the gamma decoder 410 is equal to 2×2k=2n/m. For example, if input image data has n=10 and the number of the input image data is k=7, the gamma voltage generator 411 generates 2×27 (256) analog gray voltages and the amplifier input voltage selector 412 generates four distributed outputs corresponding to logic combinations of the remaining 3 lower bits. That is, two of the analog gray voltages generated by the gamma voltage generator 411 are selected as representative analog voltages based on the upper bits, and four outputs distributed by the amplifier input voltage selector 412 are interpolated by the amplifier 420 so that voltages with magnitudes between the representative analog voltages can be generated. The amplifier input voltage selector 412, as will be described later with reference to FIG. 5, can generate five voltages using the four distributed outputs and, accordingly, the amplifier 420 generates five interpolated voltages OUT corresponding to the five voltages. Therefore, the number of the interpolated voltages OUT generated by the amplifier 420 is 210, and, accordingly, 1024 grays can be displayed by each pixel of the LCD panel.

By using the interpolation scheme, it may be possible to reduce the number of gates required for a gamma decoder, thus minimizing a circuit area, and to reduce the number of analog gray voltages to be generated by a gamma voltage generator.

Figure 5:
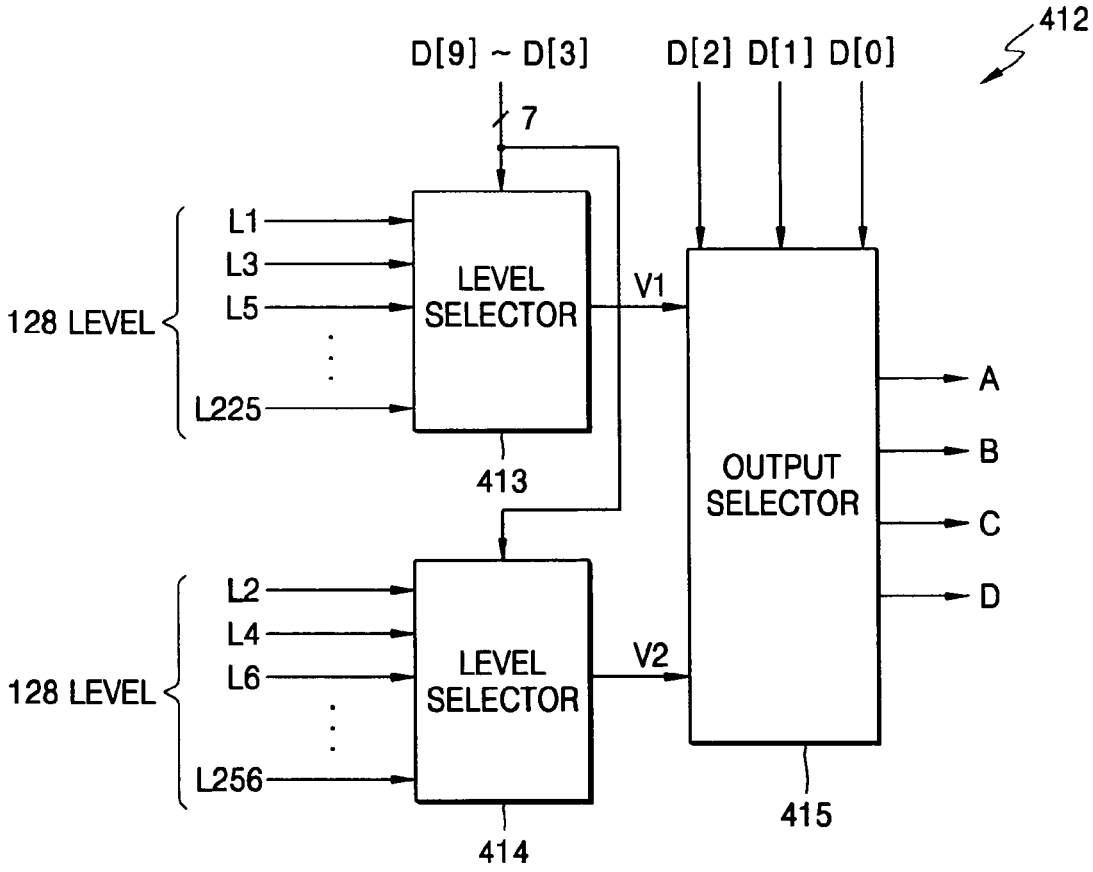
FIG. 5 is a block diagram of an amplifier input voltage selector of FIG. 4 according to a first embodiment of the present invention.

FIG. 5 is a block diagram of the amplifier input voltage selector 412 of FIG. 4 according to a first embodiment of the present invention. The amplifier input voltage selector 412 selects two voltages V1 and V2 among 2×128 analog gray voltages L1 through L256 generated by the gamma voltage generator 411 using the upper 7 bits D[3] through D[9] and the lower 3 bits D[0] through D[2] of 10 bits of input image data D[0] through D[9], and selectively outputs at least one of the two selected voltages V1 and V2 as the four distributed outputs A, B, C, and D according to the logic values represented by the lower 3 bits D[0] through D[2] of the input image data. Referring to FIG. 5, the amplifier input voltage selector 412 includes a first level selector 413, a second level selector 414, and an output selector 415.

The first level selector 413 selects one of first analog gray voltages L1, L3, L5, . . . , L255 generated by the gamma voltage generator 411 corresponding to a digital value of the upper 7 bits D[3] through D[9], and outputs the selected gray voltage as a first voltage V1. The second level selector 414 selects one of second analog gray voltages L2, L4, L6, . . . , L256 generated by the gamma voltage generator 411 corresponding to a digital value of the upper 7 bits D[3] through D[9], and outputs the selected gray voltage as a second voltage V2. Each of the second analog gray voltages L2, L4, L6, . . . , L256 is an analog voltage with a magnitude between any two of the first analog gray voltages L1, L3, L5, . . . , L255. The analog gray voltages L1 through L256 sequentially increase.

Figures 6, 7:
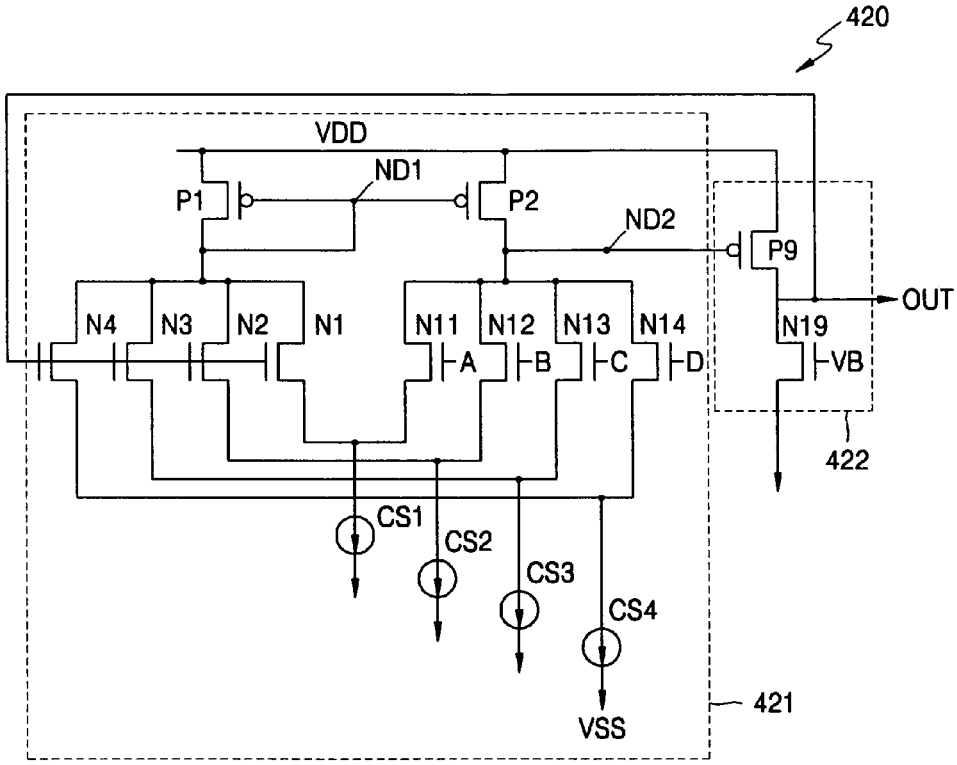
FIG. 6 is a circuit diagram of an amplifier of FIG. 4 according to the first embodiment of the present invention.
FIG. 7 is a table of input/output signals of the amplifier of FIG. 6 according to some embodiments of the present invention.

The output selector 415 selectively outputs (distributes) at least one of the first voltage V1 and the second voltage V2 as the four distributed outputs A, B, C, and D in response to the lower 3 bits D[0] through D[2]. Five combinations of the four distributed outputs A, B, C, and D can be generated according to five logic combinations of the lower 3 bits D[0] through D[2], as shown in FIG. 7. Logic combinations other than these five logic combinations are not used. For example, if a digital value of the lower 3 bits is "000", the output selector 415 outputs "V1, V1, V1, V1" as the four distributed outputs A, B, C, and D. If a digital value of the lower 3 bits D[0] through D[2] is "001", the output selector 415 outputs "V1, V1, V1, V2" as the four distributed outputs A, B, C, and D. If a digital value of the lower 3 bits D[0] through D[2] is "010", the output selector 415 outputs "V1, V1, V2, V2" as the four distributed outputs A, B, C, and D. If a digital value of the lower 3 bits D[0] through D[2] is "011", the output selector 415 outputs "V1, V2, V2, V2" as the four distributed outputs A, B, C, and D. If a digital value of the lower 3 bits D[0] through D[2] is "100", the output selector 415 outputs "V2, V2, V2, V2" as the four distributed outputs A, B, C, and D. That is, the output selector 415 repeatedly combines the first voltage V1 and the second voltage V2 in an adverse direction, within the four distributed outputs A, B, C, and D.

FIG. 6 is a circuit diagram of the amplifier 420 of FIG. 4 according to the first embodiment of the present invention. Referring to FIG. 6, the amplifier 420 includes an amplification circuit 421 with a differential amplifier structure and a buffering circuit 422.

The amplification circuit 421 includes a first p-type Metal-Oxide-Semiconductor Field Effect Transistor (MOSFET) P1, a second p-type MOSFET P2, third n-type MOSFETs N1 through N4, fourth n-type MOSFETs N11 through N14, and bias circuits CS1 through CS4.

The first p-type MOSFET P1 has a gate terminal connected to a first node N1, and source and drain terminals, one of which is connected to a first supply voltage VDD, and the other of which is connected to the first node ND1. The second MOSFET P2 has a gate terminal connected to the first node ND1, and source and drain terminals, one which is connected to the first supply voltage VDD, and the other of which is connected to the output node ND2.

The gate terminals of the third n-type MOSFETs N1 through N4 receive a buffered signal transmitted from the buffering circuit 422 via the output node N2, the drain terminals thereof are connected to the first node ND1, and the source terminals thereof are respectively connected to the bias circuits CS1 through CS4. The bias circuits CS1 through CS4 are formed by applying a predetermined voltage to the gate terminals of the third n-type MOSFETs, N1 through N4, and act as voltage controlled-current sources for controlling current flowing through a second power supply VSS.

The gate terminals of the fourth n-type MOSFETs N11 through N14 receive the outputs A, B, C, and D generated by the amplifier input voltage selector 412, the drain terminals thereof are respectively connected to the output node ND2, and the source terminals thereof are connected to the source terminals of the third n-type MOSFETs N1 through N4. That is, the source terminals of the fourth n-type MOSFETs N11 through N14 are not connected to each other. Accordingly, the bias circuits CS1 through CS4 respectively connected to the source terminals of the fourth n-type MOSFETs N11 through N14 receiving the distributed outputs A, B, C, and D operate independently, so that changes in a voltage applied to each source terminal of the fourth n-type MOSFETs N11 through N14 do not influence other MOSFETs.

The buffering circuit 422 buffers a signal of the output node ND2 using a p-type MOSFET P9 and an n-type MOSFET N19 and outputs the buffered signal as an interpolated voltage OUT to the gate terminals of the third n-type MOSFETs N1 through N4. The gate terminal of the MOSFET N19 is biased at a predetermined voltage VB, like the bias circuits CS1 through CS4.

By the above-described operations of the amplifier 420, as shown in FIG. 7, V1, (3V1+V2)/2, (V1+3V2)/4, and V2 can be generated as the interpolated voltages OUT according to a digital value of the lower 3 bits D[0] through D[2], using the voltages V1 and V2 selected by the amplifier input voltage selector 412

Figure 8:
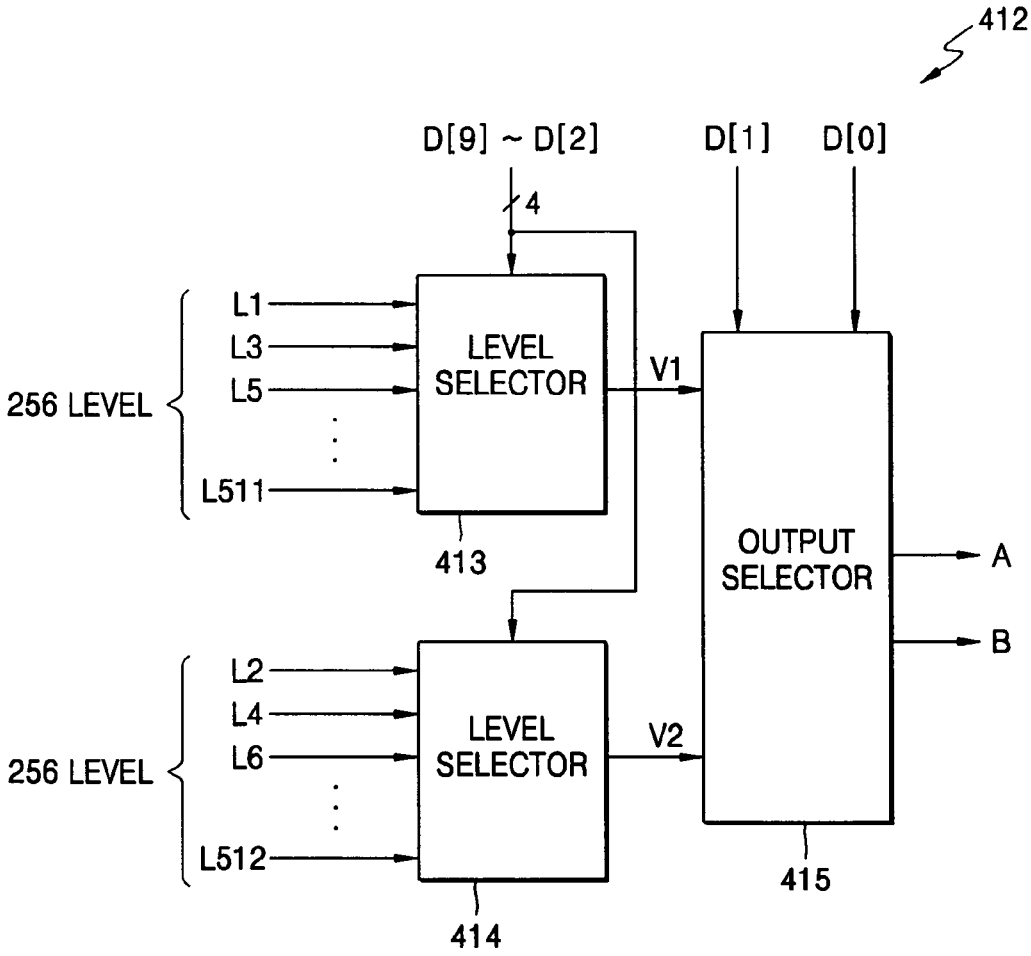
FIG. 8 is a block diagram of an amplifier input voltage selector of FIG. 4 according to a second embodiment of the present invention.

FIG. 8 is a block diagram of the amplifier input voltage selector 412 according to a second embodiment of the present invention, in which two voltages V1 and V2 among 2×256 analog gray voltages L1 through L512 generated by the gamma voltage generator 411 are selected using the upper 8 bits D[2] through D[9] and the lower 2 bits D[0] through D[9] of the 10 bits of the input image data D[0] through D[9]. The amplifier voltage selector selectively outputs at least one of the selected two voltages V1 and V2 as two distributed outputs A and B. Referring to FIG. 8, the amplifier input voltage selector 412 includes a first level selector 413, a second level selector 414, and an output selector 415.

The first level selector 413 selects a gray voltage corresponding to a digital value of the upper 8 bits D[2] through D[9] from the first analog gray voltages L1, L3, L5, . . . , L511 generated by the gamma voltage generator 411, and outputs the selected gray voltage as a first voltage V1. The second level selector 414 selects a gray voltage corresponding to a digital value of the upper 8 bits D[2] through D[9] from the second analog gray voltage L2, L4, L6, . . . , L512 generated by the gamma voltage generator 411, and outputs the selected gray voltage as a second voltage V2. Each of the second analog gray voltages L2, L4, L6, . . . , L512 is an analog voltage with a magnitude between any two of the first analog gray voltages L1, L3, L5, . . . , L511.

Figures 9, 10:
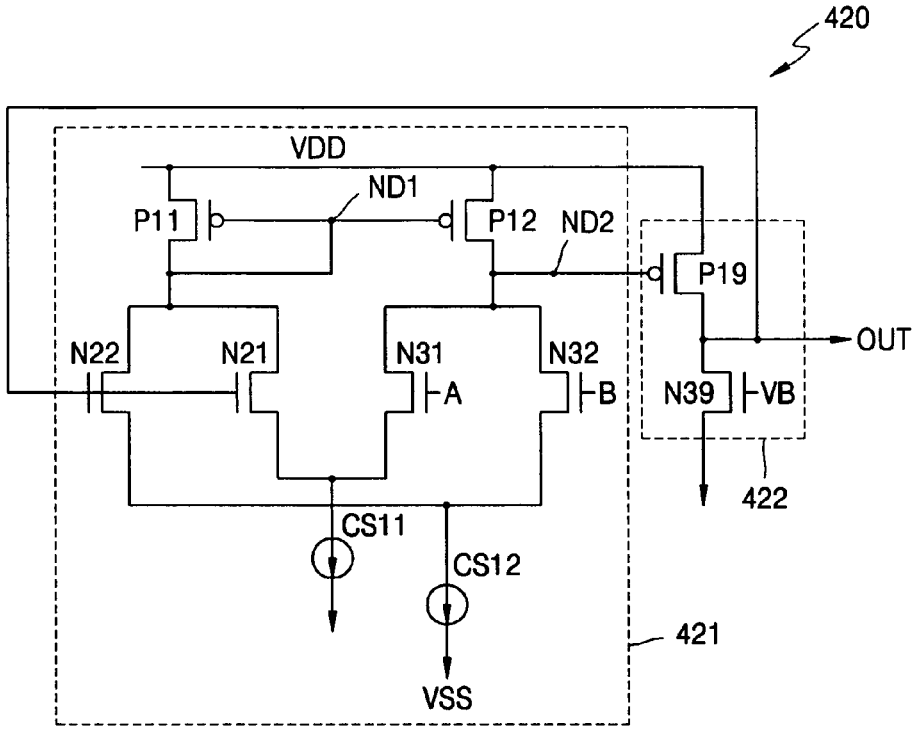
FIG. 9 is a circuit diagram of an amplifier of FIG. 4 according to the second embodiment of the present invention.
FIG. 10 is a table of input/output signals of the amplifier of FIG. 9 according to some embodiments of the present invention.
Figure 8:
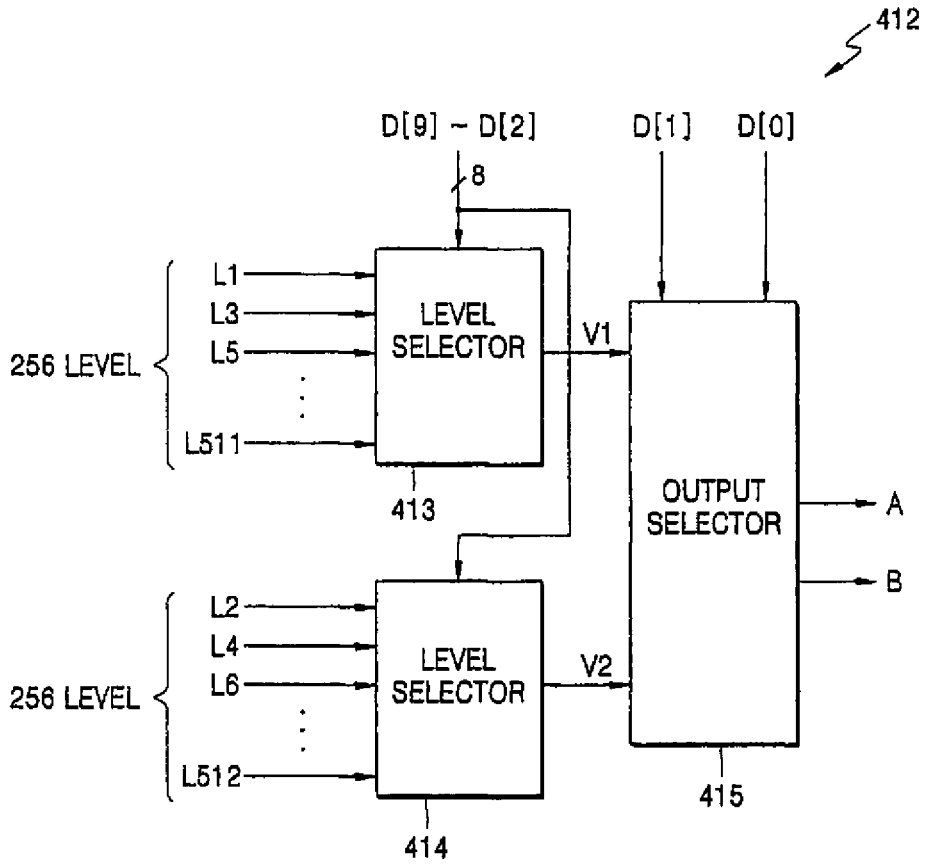

The output selector 415 selectively outputs the first voltage V1 and the second voltage V2 in response to the lower 2 bits D[0] and D[1] to generate the two distributed outputs A and B. Three combinations of the two distributed outputs A and B can be generated according to logic combinations of the lower 2 bits D[0] and D[1], as shown in FIG. 10. Logic combinations other than these three logic combinations are not used. For example, if a digital value of the lower 2 bits D[0] and D[1] is "00", the output selector 415 outputs "V1, V1" as the two distributed outputs A and B. If a digital value of the lower 2 bits D[0] and D[1] is "01,", the output selector 415 outputs "V1, V2" as the two distributed outputs A and B. If a digital value of the lower 2 bits D[0] and D[1] is "10", the output selector 415 outputs "V2, V2" as the two distributed outputs A and B. That is, the output selector 415 repeatedly combines the first voltage V1 and the second voltage V2 in an adverse direction, within the two distributed outputs A and B.

FIG. 9 is a circuit diagram of an amplifier 420 of FIG. 4 according to the second embodiment of the present invention. Referring to FIG. 9, the amplifier 420 includes an amplification circuit 421 with a differential amplifier structure and a buffering circuit 422. The amplification circuit 421 includes a first p-type MOSFET P11, a second p-type MOSFET P12, third n-type MOSFETs N21 and N22, fourth n-type MOSFETs N31 and N32, and bias circuits CS11 and CS12.

The first MOSFET P11 has a gate terminal connected to a first node ND1, and source and drain terminals, one of which is connected to a first supply voltage VDD, and the other of which is connected to the first node ND1. The second MOSFET P12 has a gate terminal connected to the first node ND1, and source and drain terminals, one of which is connected to the first supply voltage VDD, and the other of which is connected to an output node ND2. The gate terminals of the third n-type MOSFETs N21 and N22 receive a buffered signal transmitted from the buffering circuit 422 via the output node ND2, the drain terminals thereof are connected to the first node ND1, and the source terminals thereof are respectively connected to the bias circuits CS11 and CS12.

The gate terminals of the fourth n-type MOSFETs N31 and N32 receive the distributed outputs A and B from the amplifier input voltage selector 412, the drain terminals thereof are connected to the output node ND2, and the source terminals thereof are respectively connected to the source terminals of the third n-type MOSFETs N1 through N4. Accordingly, the bias circuits CS11 and CS12 connected to the source terminals of the MOSFETs N31 through N32 receiving the distributed outputs A and B operate independently so that voltage changes, etc. of the source terminal of one of the fourth n-type MOSFETs N31 and N32 do not influence the other n-type MOSFET N31 or N32.

The buffering circuit 422 buffers a signal of the output node ND2 using the p-type MOSFET P19 and an n-type MOSFET N39 and outputs the buffered signal as an interpolated voltage OUT to the gate terminals of the third n-type MOSFETs N21 and N22. The gate terminal of the n-type MOSFET N39 is biased at a predetermined voltage VB, like the bias circuits CS11 through CS12.

By the above-described operations of the amplifier 420, as shown in FIG. 10, V1, (V1+V2)/2, and V2 can be generated as the interpolated voltages OUT according to digital values of the lower 2 bits D[0] and D[1], using the first and second voltages V1 and V2 selected by the amplifier input voltage selector 412.

As described above, in a source driver 400 for driving a flat panel display device according some embodiments of the present invention, a first level selector 413 and a second level selector 414 select a first voltage V1 and a second voltage V2 from gray voltages generated by a gamma voltage generator 411, respectively, using predetermined upper bits of input image data D[1] through D[n], and an output selector 415 selectively distributes the first voltage V1 and the second voltage V2 according to the remaining lower bits, thus outputting a plurality of distributed outputs (A, B, . . . ). Accordingly, an amplifier 420 may generate uniformly distributed interpolated voltages OUT according to the distributed outputs (A, B, . . . ) using an amplification circuit 421 with a differential amplifier structure in which bias circuits (CS1, CS2, . . . ) respectively connected to source terminals of MOSFETs receiving the distributed outputs (A, B, . . . ) operate independently.

As described above, in a source driver for driving a flat panel display device, according some embodiments of the present invention, by using an interpolation scheme capable of independently operating amplifier input MOSFETs, it may be possible to remove interference between source voltages of the amplifier input MOSFETs, thereby generating uniformly distributed interpolated voltages in response to various amplifier inputs. Therefore, it may also be possible to reduce the number of gates included in gamma decoders, thereby reducing an area required for a source driver integrated circuit chip while possibly enabling the development of higher quality displays.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A source driver that responds to image data by generating an output signal which can be used to drive a flat panel display, the source driver comprising:

a gamma decoder that is configured to select one of a plurality of first analog gray voltages as a first voltage based on some upper bits of the image data, to select one of a plurality of second analog gray voltages as a second voltage based on other upper bits of the image data, and to selectively output at least one of the first voltage and the second voltage as a plurality of distributed analog signals in response to lower bits of the image data; and an amplifier that is configured to interpolate between the distributed analog signals from the gamma decoder to generate the output signal of the source driver, wherein the amplifier comprises:

a plurality of bias circuits that are each configured to generate a bias current; and a plurality of MOSFETs each having a source, a drain, and a gate terminal, wherein the gate terminal of each of the MOSFETS is separately connected to receive a different one of the distributed analog signals from the gamma decoder, and one of the source and drain terminals of each of the MOSFETS is separately connected to a different one of the bias circuits to receive the bias current, and the other one of the source and drain terminals of each of the MOSFETS is connected together at an output node to generate an interpolated signal, wherein the output signal is based on the interpolated signal.

2. The source driver of claim 1, wherein the gamma decoder comprises:

a gamma voltage generator that is configured to generate the plurality of first analog gray voltages and the plurality of second analog gray voltages based on a number of different logic combinations of the upper bits of the image data; and an amplifier input voltage selector that is configured to select one of the plurality of first analog gray voltages as the first voltage in response to some upper bits of the image data, and to select one of the plurality of second analog gray voltages as the second voltage in response to other upper bits of the image data, and configured to selectively output at least one of the first voltage and the second voltage as the plurality of distributed analog signals in response to the lower bits of the image data.

3. The source driver of claim 2, wherein the amplifier input voltage selector comprises:

a first level selector that is configured to select one of the plurality of first analog gray voltages as the first voltage in response to some of the upper bits of the image data;

a second level selector that is configured to select one of the plurality of second analog gray voltages as the second voltage in response to other of the upper bits of the image data; and an output selector that is configured to selectively output at least one of the first voltage and the second voltage as the plurality of distributed analog signals in response to the lower bits of the image data.

4. The source driver of claim 3, wherein the output selector selectively outputs different combinations of the first and second voltages across the plurality of distributed analog signals in response to the lower bits of the image data.

5. The source driver of claim 3, wherein the plurality of distributed analog signals comprises first and second analog signals, and the output selector outputs the first voltage as both of the first and second analog signals in response to a first logical value of a lower two bits of the image data, the output selector outputs the first voltage as the first analog signal and outputs the second voltage as the second analog signal in response to a second logical value of the lower two bits of the image data, and the output selector outputs the second voltage as both of the first and second analog signals in response to a third logical value of the lower two bits of the image data.

6. The source driver of claim 3, wherein the plurality of distributed analog signals comprises first, second, third, and fourth analog signals, and the output selector outputs the first voltage as each of the first, second, third, and fourth analog signals in response to a first logical value of a lower three bits of the image data, the output selector outputs the first voltage as the first, second, and third analog signals and outputs the second voltage as the fourth analog signal in response to a second logical value of the lower three bits of the image data, the output selector outputs the first voltage as the first and second analog signals and outputs the second voltage as the third and fourth analog signals in response to a third logical value of the lower three bits of the image data, the output selector outputs the first voltage as the first analog signal and outputs the second voltage as the second, third and fourth analog signals in response to a fourth logical value of the lower three bits of the image data, and the output selector outputs the second voltage as each of the first, second, third and fourth analog signals in response to a fifth logical value of the lower three bits of the image data.

7. The source driver of claim 1, wherein magnitudes of numbered ones of the second analog gray voltages are between magnitudes of adjacent numbered ones of the first analog gray voltages.

8. The source driver of claim 1, wherein the amplifier comprises:

a first MOSFET with a gate terminal, a source terminal, and a drain terminal, wherein the gate germinal is connected to a first node, one of the source and drain terminals is connected to a first supply voltage, and the other one of the source and drain terminals is connected to the first node;

a second MOSFET with a gate terminal, a source terminal, and a drain terminal, the gate terminal is connected to the first node, one of the source and drain terminals is connected to the first supply voltage, and the other one of the source and drain terminals is connected to an output node;

a plurality of third MOSFETs each having a gate terminal, a source terminal, and a drain terminal, each of the gate terminals is connected to the output terminal to receive a buffered signal, each of the drain terminals is connected to the first node, and each of the source terminals is connected to a different one of the bias circuits;

a plurality of fourth MOSFETs each having a gate terminal, a source terminal, and a drain terminal, each of the gate terminals is connected to receive a different one of the distributed analog signals, each of the drain terminals is connected to the output node, and each of the source terminals is connected to a different one of the source terminals of the plurality of third MOSFETs; and a buffer circuit that is configured to buffer the signal from the output node and to generate therefrom the output signal of the source driver.

9. The source driver of claim 1, wherein the amplifier interpolates between the distributed analog signals from the gamma decoder to generate as the output signal a voltage with a level that corresponds to one of the first voltage, an average of the first and second voltage, and the second voltage.

10. The source driver of claim 1, wherein the amplifier interpolates between the distributed analog signals from the gamma decoder to generate as the output signal a voltage with a level that corresponds to one of V1, (3V1+V2)/4, (V1+V2)/2, (V1+3V2)/4, and V2, wherein V1 is the first voltage and V2 is the second voltage.

11. A method of driving a flat panel display device responsive to image data, the method comprising:

generating first analog gray voltages based on a number of different logic combinations of upper bits of the image data;

generating second analog gray voltages based on the number of different logic combinations of the upper bits of the image data;

selecting one of the first analog gray voltages as a first voltage based on some upper bits of the image data;

selecting one of the second analog gray voltages as a second voltage based on other upper bits of the image data;

selectively outputting at least one of the first voltage and the second voltage as a plurality of distributed analog signals in response to lower bits of the image data;

generating a plurality of separate bias currents; and interpolating between the distributed analog signals using the separate bias currents to generate the output signal of the source driver.

12. The method of claim 11, wherein selectively outputting at least one of the first voltage and the second voltage as a plurality of distributed analog signals in response to lower bits of the image data comprises selectively outputting different combinations of the first and second voltages across the plurality of distributed analog signals in response to the lower bits of the image data.

13. The method of claim 11, wherein the plurality of distributed analog signals comprises first and second analog signals, and wherein selectively outputting at least one of the first voltage and the second voltage as a plurality of distributed analog signals in response to the lower bits of the image data comprises outputting the first voltage as both of the first and second analog signals in response to a first logical value of a lower two bits of the image data, outputting the first voltage as the first analog signal and outputting the second voltage as the second analog signal in response to a second logical value of the lower two bits of the image data, and outputting the second voltage as both of the first and second analog signals in response to a third logical value of the lower two bits of the image data.

14. The driving method of claim 11, wherein the plurality of distributed analog signals comprises first, second, third, and fourth analog signals, and wherein selectively outputting at least one of the first voltage and the second voltage as a plurality of distributed analog signals in response to the lower bits of the image data comprises outputting the first voltage as each of the first, second, third, and fourth analog signals in response to a first logical value of a lower three bits of the image data, outputting the first voltage as the first, second, and third analog signals and outputting the second voltage as the fourth analog signal in response to a second logical value of the lower three bits of the image data, outputting the first voltage as the first and second analog signals and outputting the second voltage as the third and fourth analog signals in response to a third logical value of the lower three bits of the image data, outputting the first voltage as the first analog signal and outputting the second voltage as the second, third and fourth analog signals in response to a fourth logical value of the lower three bits of the image data, and outputting the second voltage as the first, second, third and fourth analog signals in response to a fifth logical value of the lower three bits of the image data.

15. The method of claim 11, wherein magnitudes of numbered ones of the second analog gray voltages are between adjacent numbered ones of the first analog gray voltages.

16. The method of claim 11, wherein interpolating between the distributed analog signals using the separate bias currents to generate the output signal of the source driver comprises generating the output signal with a level that corresponds to one of V1, (V1+V2)/2, and V2, wherein V1 is the first voltage and V2 is the second voltage.

17. The method of claim 11, wherein interpolating between the distributed analog signals using the separate bias currents to generate the output signal of the source driver comprises generating the output signal with a level that corresponds to one of V1, (3V1+V2)/4, (V1+V2)/2, (V1+3V2)/4, and V2, wherein V1 is the first voltage and V2 is the second voltage.

* * * * *

UNITED STATES PATENT AND TRADEMARK OFFICE

CERTIFICATE OF CORRECTION

PATENT NO. : 7,511,694 B2
APPLICATION NO. : 11/258471
DATED : March 31, 2009
INVENTOR(S) : Hyung-tae Kim et al.

It is certified that error appears in the above-identified patent and that said Letters Patent is hereby corrected as shown below:

In the Drawings:

Please Delete Figure 8 and Substitute the attached replacement sheet including Figure 8

In the Claims:

Column 10, Claim 1, Line 7: Please correct "based on some" to read -- based on --

Column 10, Claim 1, Line 9: Please correct "based on other" to read -- based on the --

Column 10, Claim 2, Line 7: Please correct "in response to some" to read -- in response to the --

Column 10, Claim 2, Lines 41-42: Please correct "in response to other" to read -- in response to the --

Column 10, Claim 3, Line 50: Please delete "some of"

Column 10, Claim 3, Line 53: Please delete "other of"

Column 12, Claim 11, Line 14: Please correct "based on some" to read -- based on the --

Column 12, Claim 11, Line 16: Please correct "based on other" to read -- based on the --

Signed and Sealed this

Eighteenth Day of August, 2009

David J. Kappos

David J. Kappos
*Director of the United States Patent and Trademark Office*